US005691874A

United States Patent [19]

Miyamoto et al.

[11] Patent Number: 5,691,874

[45] Date of Patent: Nov. 25, 1997

[54] POWER SWITCH CONTROL APPARATUS OF EQUIPMENT

[75] Inventors: Kazuki Miyamoto; Naoyuki Ohki, both of Yokohama; Takahiro Ushiro, Kawasaki; Teruo Mitsui, Inagi; Atsushi Chaki, Yokohama, all of Japan

[73] Assignee: Canon Kabushiki Kaisha, Tokyo, Japan

[21] Appl. No.: 578,445

[22] Filed: Dec. 26, 1995

Related U.S. Application Data

[63] Continuation of Ser. No. 302,964, Sep. 12, 1994, abandoned.

[30] Foreign Application Priority Data

Sep. 17, 1993 [JP] Japan ..... 5-231488

[51] Int. Cl.[6] ..... H01H 47/00

[52] U.S. Cl. ..... 361/170; 307/142

[58] Field of Search ..... 361/152, 160, 361/170, 194, 195; 307/125, 139, 140, 141, 142

[56] References Cited

U.S. PATENT DOCUMENTS

| | | | |
|---|---|---|---|
| 4,533,810 | 8/1985 | Harmon et al. | 307/141.4 |
| 4,787,008 | 11/1988 | Graff et al. | 361/190 |
| 4,811,051 | 3/1989 | Masuda et al. | 355/14 |
| 5,077,631 | 12/1991 | Cleary | 361/192 |
| 5,147,448 | 9/1992 | Lang | 355/309 |
| 5,448,338 | 9/1995 | Masuda et al. | 355/206 |

*Primary Examiner*—Fritz Fleming

*Attorney, Agent, or Firm*—Fitzpatrick, Cella, Harper & Scinto

[57] ABSTRACT

When the user depresses a soft key SW in an on-state of a door switch DSW in which a door is closed, a transistor Tr1 is turned on, a transistor Tr4 is turned on, a relay RL1 is turned on, and an AC power source is supplied to an image forming apparatus. When a jam occurs, a CPU 2 turns on a transistor Tr5 for a predetermined time and a latching relay RL2 is driven to the holding side. When the door is opened for a jam process, the door switch DSW is opened and the AC power drops. When the door is closed after the jam process, the door switch DSW is closed. In this instance, since the latching relay RL2 is in a holding state, the AC power is again supplied in a manner similar to the case where the soft key SW is depressed. When the jam cancellation is confirmed, the holding of the latching relay RL2 is cancelled and the ordinary operation is started.

8 Claims, 4 Drawing Sheets

SWITCHING POWER
11
5VA
24V
CPU1 (SEQUENCE CONTROL)
12
A/D Port
Port
Port
RAM
16
Jam DETECTING SENSOR
15
CPU2 (CONTROL OF SWITCHING POWER)
14
5V
P5
P1
P2
P3
P4
ABNORMAL DETECTING CIRCUIT
R3
Q1
Tr1
R1
Tr2
R2
Tr3
Tr4
Tr5
Tr6
T1
RL1
RL2
SW
DSW
VSW

POWER SWITCH CONTROL APPARATUS OF EQUIPMENT

This application is a continuation of application Ser. No. 08/302,964 filed Sep. 12, 1994, now abandoned.

BACKGROUND OF THE INVENTION

1. Field of the Invention

The invention relates to an apparatus for controlling a power supply of an image forming apparatus or the like by detecting a depression of a switch.

2. Related Background Art

A conventional image forming apparatus in which a power source is opened or closed by a soft key (key in which the depression of the key is detected by a CPU and which is used to control a power source in accordance with such a detection) will now be described with reference to FIG. 3. When a soft key SW is depressed by the user in a state in which a door switch DSW of the image forming apparatus is ON, a transistor Tr1 connected to a rectification output terminal of an output of an auxiliary transformer T1 is turned on. The 3-terminal regulator Q1 generates a voltage of 5V. When the voltage of 5V is generated from Q1, a transistor Tr4 is turned on, a relay RL connected to an AC power source path operates, and an AC power source is supplied to a switching power source 11. The operations of CPU-2 (13) is started by an output of 5V from the regulator Q1. The CPU 2 turns on a transistor Tr2 and keeps the transistor Tr1 in the ON state. The CPU 2 starts to control the switching power 11. The switching power 11 generates a DC output. A CPU-1 (12) starts the operation by an output $5V_A$ ($V_A$ is written in order to distinguish from the 5V output from the regulator Q1) of the switching power 11, so that a sequence of the image forming apparatus is executed.

However, in the above conventional example, a jam of a recording paper occurs in the image forming apparatus and the user opens the door of the image forming apparatus in order to perform a jam process, so that the door switch DSW is opened, the power drops, and the relay RL is opened. Therefore, even when the door switch DSW is turned on after completion of the jam process, the power of the image forming apparatus is not turned on. Consequently, the user must again depress the soft key SW and the operation is troublesome and is hard to use.

SUMMARY OF THE INVENTION

It is an object of the invention to provide a power switch control apparatus which can eliminate the above drawback.

Another object of the invention is to provide an image forming apparatus whose power is turned on by a soft switch, in which after an abnormal state such as a jam or the like was cancelled, the power can be again turned on without again operating the soft switch.

The above and other objects and features of the present invention will become apparent from the following detailed description and the appended claims with reference to the accompanying drawings.

DETAILED DESCRIPTION OF THE PREFERRED EMBODIMENT

The invention will now be described in detail hereinbelow with respect to an embodiment.

Figure 1:
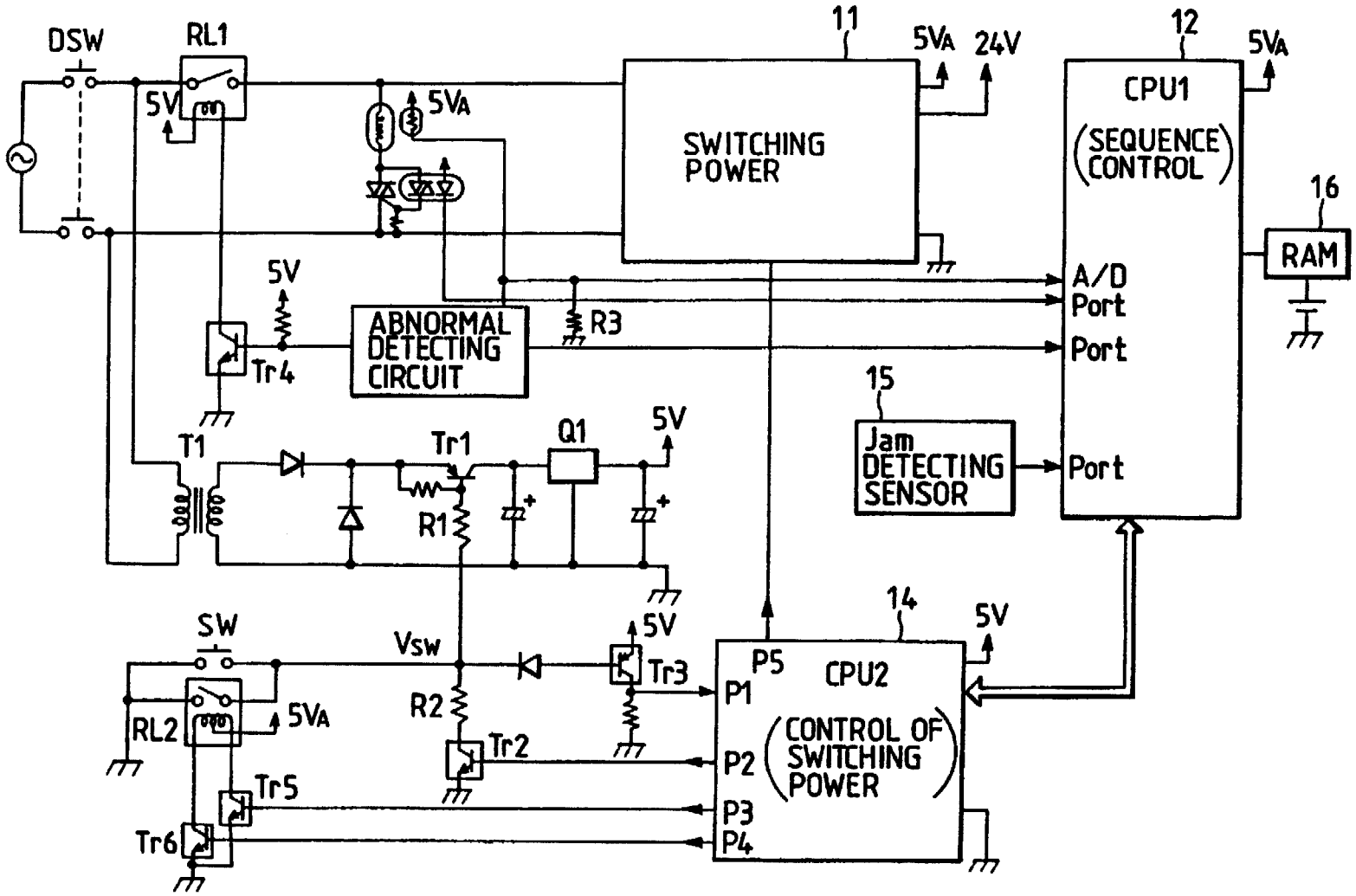
FIG. 1 is a circuit diagram showing an embodiment of a power switch control apparatus.

FIG. 1 is a circuit diagram of a power switch control apparatus of an image forming apparatus.

In FIG. 1, the door switch DSW is a safety switch which is opened or closed interlockingly with the opening or closure of a door and a cover (which are not shown) of the image forming apparatus. A relay RL1 is a relay to supply an AC power source to the image forming apparatus and is used to shut off the AC power source when an abnormality such as a jam or the like occurs. The auxiliary transformer T1 is used to produce a power source to make the relay RL1 and a CPU-2 (14) operative. The CPU 2 is a microcomputer to control the switching power 11. The soft key SW is a main switch for instructing the closure of the contact of the relay RL1, thereby supplying a power source to the main body of the image forming apparatus. The soft key SW is also a switch for instructing the opening of the contact of the relay RL1, thereby turning off the power of the image forming apparatus. The soft key SW is a self-resetting type switch (depressing state is not held). Reference character RL2 denotes a latching relay whose contacting circuit is connected in parallel with the soft key SW. Even when the power supply is cancelled, the latching relay RL2 keeps the closing state or opening state. The CPU-1 (12) is a microcomputer to control a sequence of the image forming apparatus. Reference numeral 16 denotes an RAM that is backed up by a battery.

The operation in the embodiment will be described in detail hereinbelow with reference to FIG. 1.

First, the turn-on of the power by the soft key SW will be described. When the soft key SW is depressed by the user in a state in which the door switch DSW (not shown) of the image forming apparatus is turned on (state in which the door is closed), the transistor Tr1 connected to a rectification output terminal of an output of the auxiliary transformer T1 is turned on. The 3-terminal regulator Q1 generates a voltage of 5V. An output terminal of 5V is connected to the CPU 2 and relay RL1. When 5V is Generated from Q1, a contact of the relay RL1 connected to the AC power source line is closed because the transistor Tr4 is turned on. An AC power source is supplied to the switching power 11. The CPU 2 starts the operation by the output of 5V from Q1, the transistor Tr2 is turned on, and the transistor Tr1 is held in the ON state. Therefore, even when the contact of the soft switch SW is opened, the contact of the relay RL1 is held in the closed state. In this instance, a potential Vsw at one end of the soft key SW is set so as to be higher than the output of the 3-terminal regulator Q1. Namely, the transistor Tr3 is turned off. Further, the CPU 2 starts to control the switching power 11 and the switching power 11 generates a DC voltage. The CPU 1 starts the operation by the output $5V_A$ of the switching power 11 and the sequence of the image forming apparatus is executed.

The operation at the time when the power is turned off by the soft key SW will now be described. When the soft key SW is depressed in a state in which a power source is supplied to the image forming apparatus, the potential Vsw is set to 0, the transistor Tr3 is turned on, and a port P1 of the CPU 2 which monitors the operation of the soft key SW is set to the high level. Due to this, the CPU 2 turns off the transistor Tr2 which has been turned on to continuously Generate 5V from Q1. Due to this, the transistor Tr1 is also turned off and the voltage of 5V is not generated from Q1.

Consequently, the relay RL1 is turned off, its contact is open, and the power of the image forming apparatus is turned off. As described above, the power source can be turned on or off by the soft key SW.

Figure 2A:
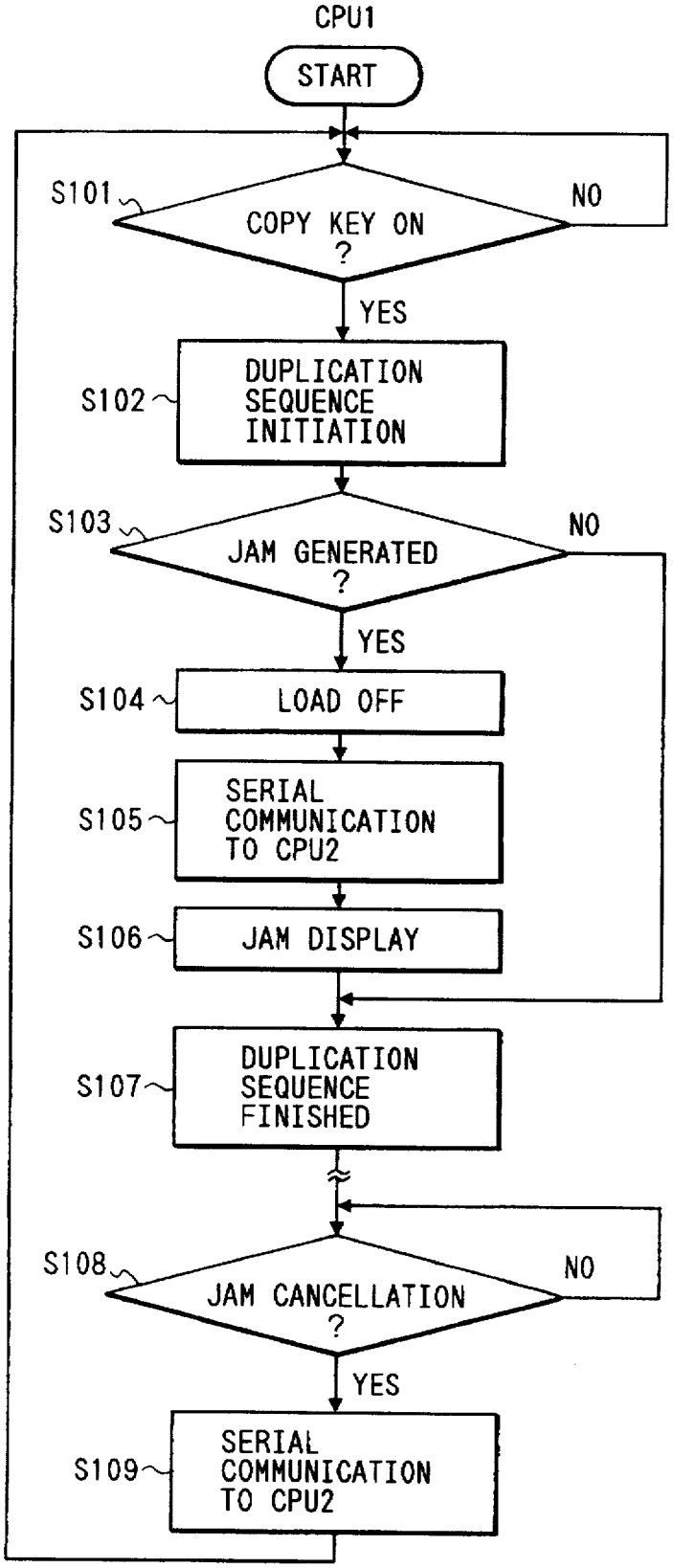
FIGS. 2A and 2B are operation flowcharts for CPU 1 and CPU 2 in FIG. 1.
Figure 2B:
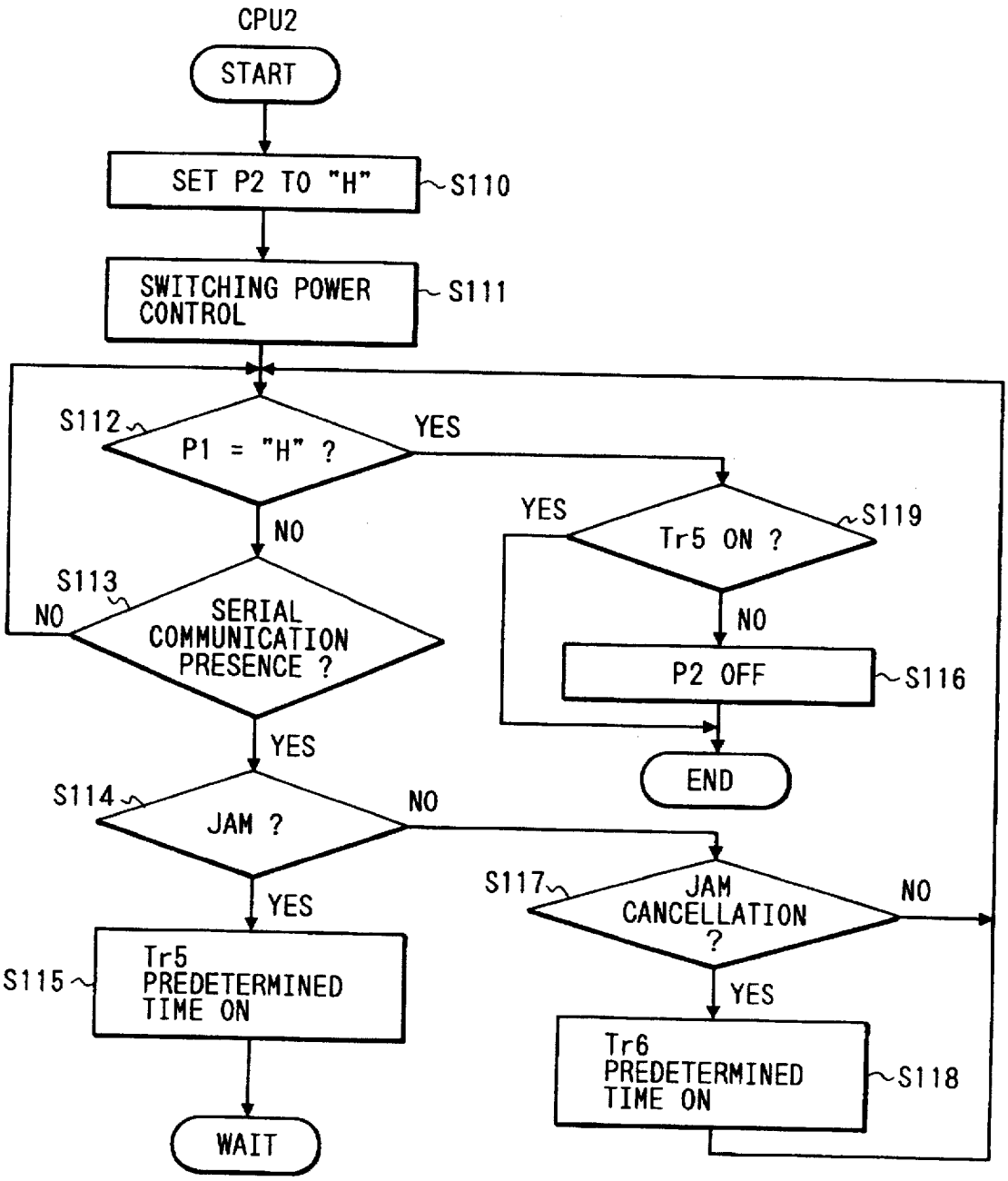
Figure 3:
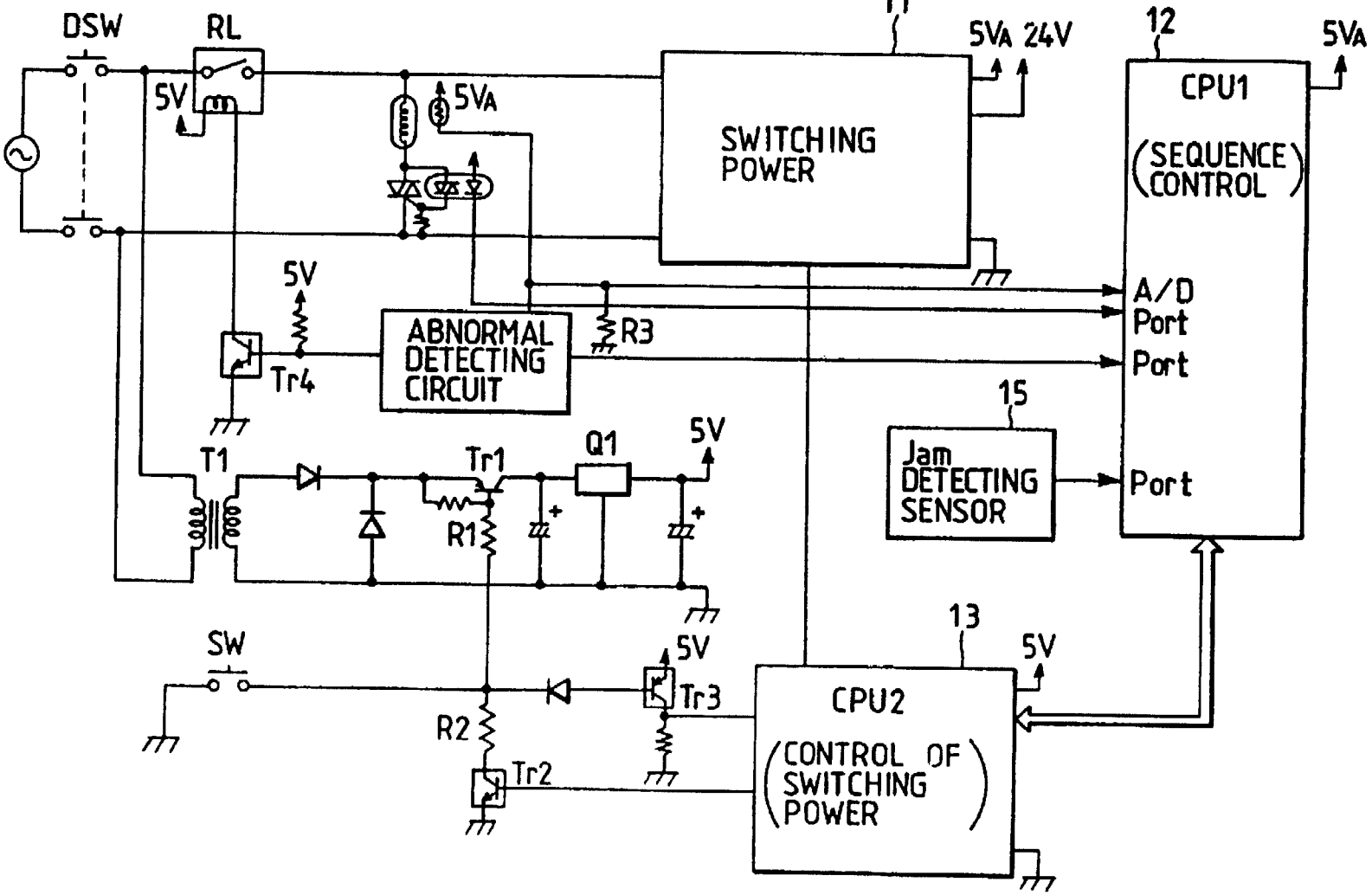
FIG. 3 PRIOR ART
FIG. 3 is a circuit diagram showing a conventional example of a power switch control apparatus.

The operation of the embodiment will now be described with reference to flowcharts of FIGS. 2A and 2B.

When the copy start key is depressed (YES in step S101), the CPU 1 sequentially turns on loads which are necessary for a duplication sequence and executes the sequence (S102). The CPU 1 detects the presence or absence of a jam (abnormality of conveyance of the recording medium) by a signal from a sensor for detection of a jam arranged at a position where a copy paper (recording medium) passes.

The operation when the jam occurs will now be described. The CPU 1 monitors an output of the jam detecting sensor. When the occurrence of the jam is detected (YES in step S103), the loads such as motor, fixing unit, exposure lamp, and the like which are driven are turned off (S104). The occurrence of jam is informed to the CPU 2 by a serial communication (S105). The occurrence of the jam is displayed on a display (S106). When the occurrence of the jam is known by the serial communication (YES in steps S113 and S114), the CPU 2 turns on a transistor Tr5 for a predetermined time, thereby making conductive a winding on the holding side (Tr5 side) of the latching relay RL2 connected in parallel with the soft key SW for a predetermined time and closing the contact of the relay RL2 (S115). Such a closed state is also mechanically maintained after the turn-off of the transistor Tr5.

The CPU 2 always monitors whether the contact of the latching relay RL2 is closed or not by the voltage of the port P1 (S112). When the jam occurs, since the contact is closed (YES in step S112), the processing routine advances to step S119 and a check is made to see if the transistor Tr5 is ON or not. If YES, the processing routine is finished. When the transistor Tr5 is not yet turned on, the transistor Tr2 is turned off (S116), thereby stopping the operation of the regulator Q1.

In this instance, the CPU 1 stores the occurrence of the jam into the backup memory 16. After that, when the door switch DSW is turned on and the power is again turned on, the processing routine on the CPU 1 side is started from step S108.

When the user opens the cover of the image forming apparatus for a jam process, the door switch DSW is turned off and the AC power source is shut off.

After completion of the jam process, by closing the cover, the door switch DSW is turned on and the AC power source is supplied to the transformer T1. On the other hand, since the contact of the latching relay RL2 is connected to the holding side (closed state), the power source is supplied to the image forming apparatus in a manner similar to the case where the soft key SW is depressed. After confirming that the jam is not again detected by the jam detecting sensor (the jam process was performed) (S108), the CPU 1 informs the cancellation of the jam to the CPU 2 by the serial communication (S109). When the CPU 2 receives the information of such a jam cancellation, the processing routine advances from step S113 to step S118 through steps S114 and S117. A transistor Tr6 is turned on for a predetermined time, thereby making conductive a winding on the cancellation side (Tr6 side) of the latching relay RL2 for a predetermined time. Due to this, the contact of the latching relay RL2 connected in parallel with the soft key (SW) is opened and the apparatus is returned to an ordinary operating state.

In the embodiment, although the closing or opening of the power line has been instructed by the soft key SW, the invention is not limited to such an example. For example, the opening of the power line can be also performed by instructing by using another soft key. In the embodiment, the relay RL1 has been held by the CPU 2 in a software manner. However, such a holding process can be also performed by an electric circuit in a hardware manner. Namely, the switch SW is not limited to the soft key.

The present invention is not limited to the foregoing embodiment but many modifications and variations are possible within the spirit and scope of the appended claims of the invention.

What is claimed is:

1. A power switch control apparatus of an equipment having:

a door switch for shutting off a power supply in response to an opening of a door to access an inside of said equipment;

a relay circuit which is connected serially to said door switch and is used to turn on/off the power supply;

a main switch that is manually operated in order to turn on the power source to said equipment;

driving means for driving said relay circuit in response to the operation of said main switch and for turning off the relay circuit in response to the opening of said door; and detecting means for detecting an abnormality of said equipment, wherein said switch control apparatus comprises holding means for generating a same signal to be generated in a state in which said main switch is operated when the abnormality is detected by said detecting means, for holding such a generation state even if said door is opened, and for cancelling the holding state after the door was closed.

2. An apparatus according to claim 1, wherein said main switch is a self-resetting type switch which doesn't hold the on-state.

3. A power switch control apparatus of an equipment having:

a door switch for shutting off a power supply in response to an opening of a door to access an inside of said equipment;

a relay circuit which is connected serially to said door switch and is used to turn on/off the power supply;

a main switch that is manually operated in order to turn on the power source to said equipment;

driving means for driving said relay circuit in response to the operation of said main switch and for turning off the relay circuit in response to the opening of said door; and detecting means for detecting an abnormality of said equipment, wherein said switch control apparatus comprises holding means that is connected in parallel with said main switch and holds a state in which the main switch is turned on, and control means for setting said holding means into a holding state when the abnormality is detected by said detecting means and for cancelling said holding state after the door was closed from the opening state.

4. An apparatus according to claim 3, wherein said main switch is a self-resetting type switch which doesn't hold the on-state.

5. A power switch control apparatus of an equipment, comprising:

a switch that is manually operated to turn on a power source to said equipment;

shut-off/conducting means for shutting off or conducting a power supply to the equipment from the power source;

instructing means for instructing so as to set said shut-off/conducting means into a conductive state in response to that said switch is manually operated;

holding means for mechanically holding the instructing state of said instructing means;

detecting means for detecting an abnormality of said equipment; and control means for setting said holding means into a holding state so that said instructing means instructs the conductive state when the abnormality is detected by said detecting means and for cancelling the holding state of said holding means when said abnormality is cancelled.

6. A power switch control apparatus of an equipment comprising:

a door switch for shutting off a power supply in response to an opening of a door to access an inside of said equipment;

a relay circuit which is connected serially to said door switch and is used to turn on/off the power supply;

a main switch that is manually operated in order to turn on the power source to said equipment, wherein said main switch is a self-resetting type switch which does not hold the on-state;

driving means for driving said relay circuit in response to the operation of said main switch and for turning off the relay circuit in response to the opening of said door; and generating means for generating a same signal to be generated in a state in which said main switch is operated without operating said main switch in response to the door closing after the relay circuit is turned off by the opening of said door, wherein said driving means drives the relay circuit in response to the signal from said generating means.

7. An apparatus according to claim 6, further comprising detecting means for detecting an abnormality of said equipment, wherein said generating means generates the signal on condition that said detecting means detected the abnormality.

8. An apparatus according to claim 6, wherein said generating means generates the signal for a predetermined time.

* * * * *

UNITED STATES PATENT AND TRADEMARK OFFICE

CERTIFICATE OF CORRECTION

PATENT NO. : 5,691,874

DATED : November 25, 1997

INVENTOR(S) : Kazuki Miyamoto, et al.

It is certified that error appears in the above-identified patent and that said Letters Patent is hereby corrected as shown below:

COLUMN 1

Line 27, "operations" should read --operation--; and
Line 33, "distinguish" should read --distinguish it--.

COLUMN 2

Line 29, "an" should read --a--; and
Line 42, "Generated" should read --generated--.

Signed and Sealed this

Twenty-second Day of September, 1998

Bruce Lehman

*Attest:*

BRUCE LEHMAN

*Attesting Officer*

*Commissioner of Patents and Trademarks*